US005134775A

United States Patent [19]

Althaus et al.

[11] Patent Number: 5,134,775

[45] Date of Patent: Aug. 4, 1992

[54] SHAVER HEAD WITH DISPENSER

[75] Inventors: Wolfgang Althaus, Wuppertal; Michael Schwarz, Herne, both of Fed. Rep. of Germany

[73] Assignee: Wilkinson Sword Gesellschaft mit beschränkter Haftung, Solingen, Fed. Rep. of Germany

[21] Appl. No.: 585,193

[22] Filed: Sep. 20, 1990

[30] Foreign Application Priority Data

Sep. 21, 1989 [DE] Fed. Rep. of Germany ... 8911246[U]

[51] Int. Cl.[5] ..... B26B 19/40; B26B 19/48

[52] U.S. Cl. ..... 30/41; 30/41.5

[58] Field of Search ..... 30/41, 41.5, 84, 123.3, 30/34

[56] References Cited

U.S. PATENT DOCUMENTS

| | | | |
|---|---|---|---|
| 2,120,940 | 6/1938 | Minassian . | |
| 2,677,883 | 5/1954 | Schallgruber . | |
| 3,768,161 | 10/1973 | Miller . | |
| 3,969,817 | 7/1976 | DiBuono | 30/41 |
| 4,077,119 | 3/1978 | Sellera | 30/41 |
| 4,238,882 | 12/1980 | Harrison, Sr. | 30/41 |
| 4,562,644 | 1/1986 | Hitchens . | |
| 4,697,342 | 10/1987 | Ferraro . | |
| 4,709,476 | 12/1987 | Shurtleff . | |
| 4,760,642 | 8/1988 | Kwak | 30/41 |
| 4,809,432 | 3/1989 | Schauble | 30/41 |
| 4,850,107 | 7/1989 | Valliades et al. . | |
| 4,996,772 | 3/1991 | Iten | 30/41 |

FOREIGN PATENT DOCUMENTS

| | | |
|---|---|---|
| 340300 | 11/1921 | Fed. Rep. of Germany . |
| 2851457 | 6/1979 | Fed. Rep. of Germany . |
| 279398 | 3/1952 | Switzerland . |

*Primary Examiner*—Douglas D. Watts
*Assistant Examiner*—Paul M. Heyrana, Sr.
*Attorney, Agent, or Firm*—Robert W. Becker & Associates

[57] ABSTRACT

The invention relates to a shaver head for a wet shaver. The shaver head is arranged at the front end of a handle. A razor blade, in the form of a single or double razor blade, is fastened in a plastic housing. The shaver head has a front guide strip and a rear cover cap. The shaver head includes a shaving preparation, which is dispensed during shaving. The shaver head has a storage device for receiving the liquid shaving preparation, skin care preparation or the like and a dispenser for dispensing the preparation during shaving.

46 Claims, 9 Drawing Sheets

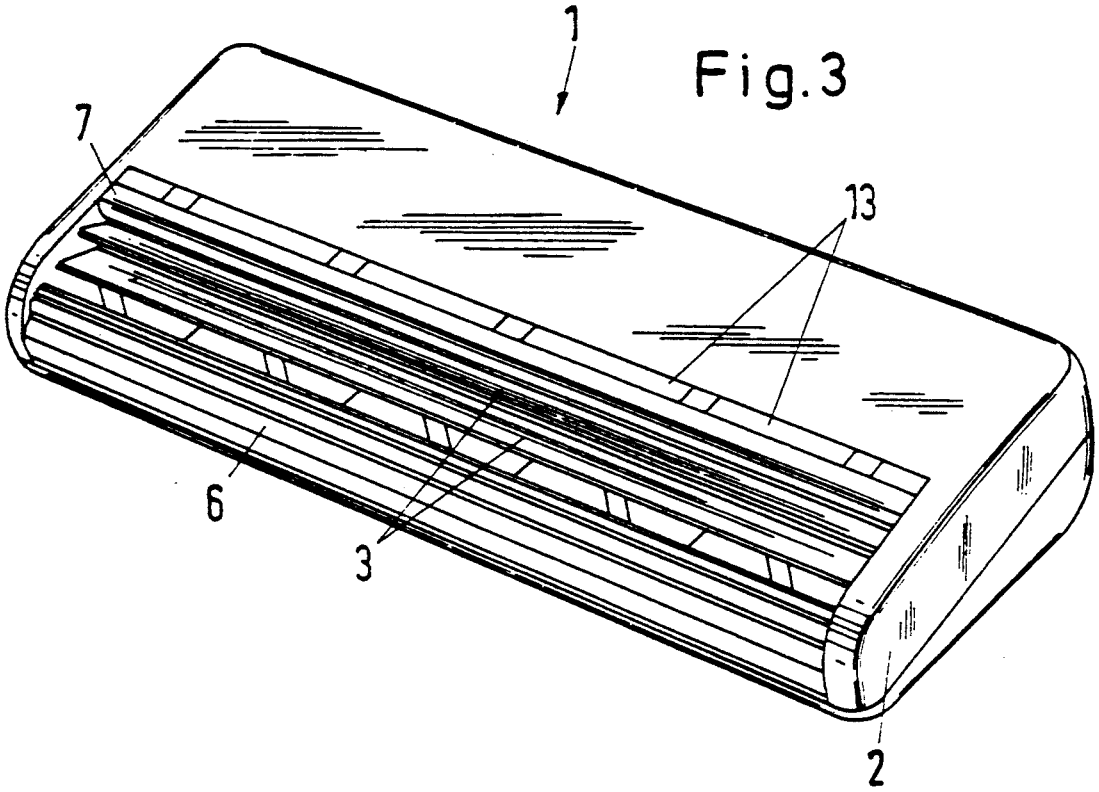
Fig.3
Fig.4
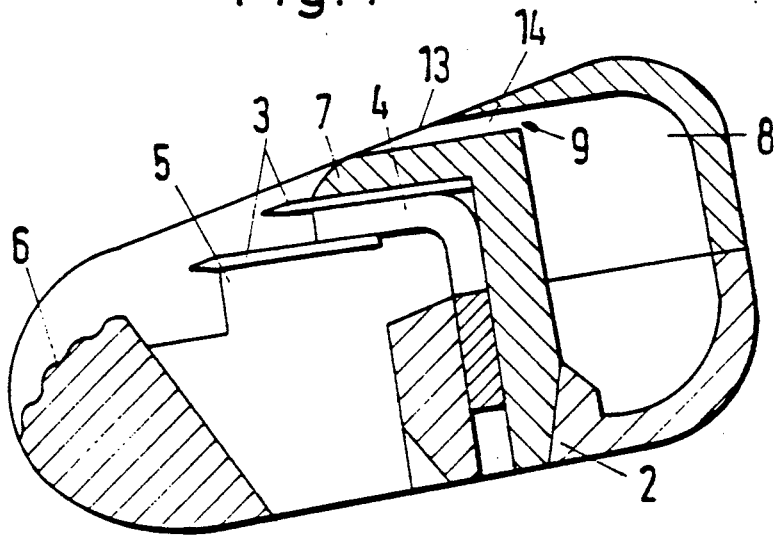

Fig.13
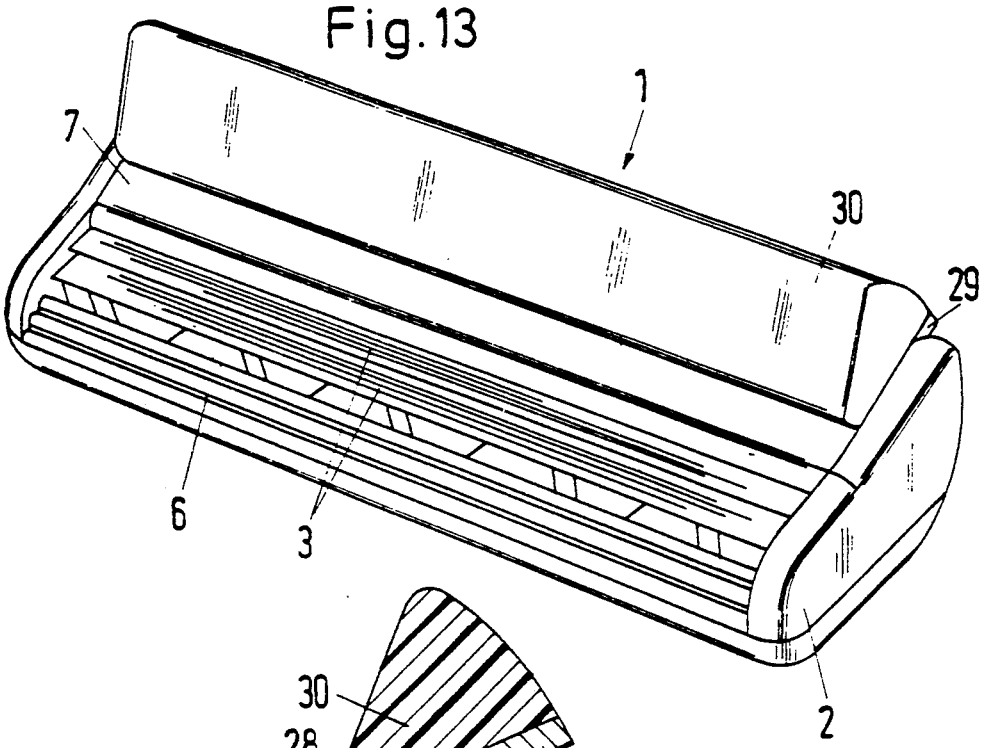
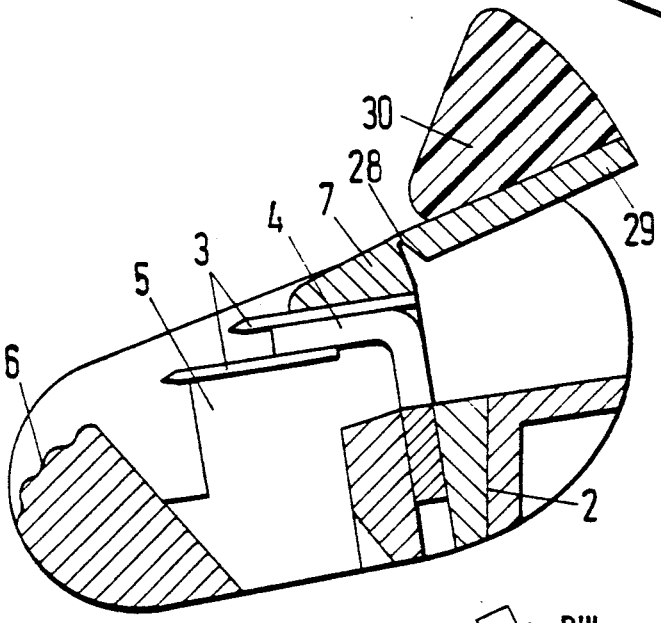
Fig.14a
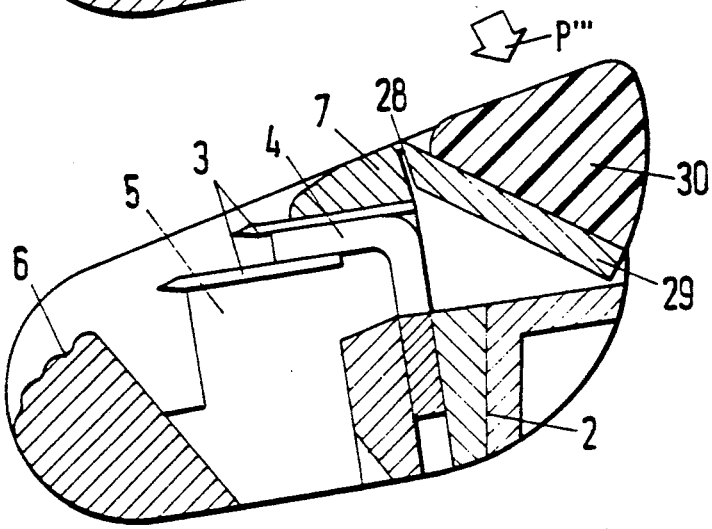
Fig.14b

SHAVER HEAD WITH DISPENSER

BACKGROUND OF THE INVENTION

1. Field of the Invention

The present invention relates to a shaver head for a wet shaver. The shaver head is arranged at the front of a handle, and has a single or double razor blade fastened in a plastic housing having a front guide strip and a rear cover cap. The shaver head includes a shaving preparation which is dispensed during shaving.

2. Description of Related Art

In conventional wet shavers, a single or double razor blade is permanently embedded in a plastic housing in the shaver head. If the shaver head is constructed separately and can be fastened to a handle by corresponding interlocking devices, the shaver head is known as a razor blade unit.

It is common to fit razor blade units with an additional slide strip, in order to make shaving more comfortable by reducing friction. The slide strip is provided with a shaving preparation which is dispensed during shaving. Two shaving preparation systems are essentially distinguished.

The first system is based on a mixture of water-soluble plastic of the polyox (PEO) type, and water-insoluble polystyrene (PS). The PEO/PS slide strips are available in various forms, and can be manufactured by various production methods. It is common to all these slide strips that during shaving, a specific quantity, for the most part between 1 and 5 milligrams, of the water soluble plastic is applied.

It is a disadvantage of the first system that during shaving the application of the polyox takes place very inaccurately and depends greatly upon the individual's shaving habits. It also appears that even during the second and third shaves, the quantity of polyox released decreases, resulting very quickly in a perceptible reduction in shaving comfort. A further disadvantage of this first system resides is that even after a few applications, the slide strip starts to look very messy. Moreover, the slide strip is sensitive with respect to humidity, which is present, in particular, in the bathroom With polyox solutions the viscosity arising during shaving depends strongly upon the individual shaving behavior of the user, namely, upon how greatly the slide strip is wetted with water. If the razor blade unit is treated unevenly, the undesirable effects occur and the user criticizes the "stickiness" of the slide strip. Finally, with the first system, the water-soluble slide strip is produced from plastic, which although classified as dermatological acceptable, does not allow the desired shaving effect to be achieved with natural substances. The reason for this is that the production process requires temperatures that would decompose natural substances. Because of the production process, again, the addition of a shaving or skin preparation agent is not possible, as the temperatures required in the production of the slide strip are higher than 200° C.

The second system is based on a film with ultraslide properties, which likewise reduces the frictional force during shaving and thus guarantees a comfortable shave. In the previously described first system, quantities of polyox that can be clearly established and measured are applied to the shaving surface. However, this is not required in the second system in order to achieve the same effect.

The film with ultraslide properties of the second system thus achieves a comfortable shave without the previously described disadvantages of the first system. There is no perceptible application of lubricants to the skin, so performance is further retained over a lengthy period and for several shaves. Furthermore no messy appearance results during use. With respect to atmospheric humidity and heat, sensitivity is reduced. However, because of the mechanism during shaving, it is not possible to apply a liquid, natural shaving preparation, any skin preparations or scented shaving preparations.

SUMMARY OF THE INVENTION

It is the object of the invention to develop a shaver head, in particular a razor blade unit, which dispenses liquid shaving preparations, skin care preparations or the like during shaving.

The invention proposes as a technical solution that the shaver head has storage means for receiving a liquid shaving preparation, skin care preparation or the like. The storage means include a dispensing means for dispensing the preparation during shaving.

A shaver head, in particular a razor blade unit, constructed according to this technical teaching has the advantage that it is possible to apply liquid, natural and, as the case may be, scented shaving preparations and skin care preparations or the like during shaving. This is achieved according to the invention when the shaver head has a storage means for these liquid preparations, which are then dispensed by dispensing means as required during shaving. The storage means became possible due to the development of narrow razor blades, without thereby producing at the same time a disadvantageous enlargement of the razor blade unit for storing the liquid preparation. It is therefore possible to apply shaving preparations or general treatment preparations with a viscosity that does not change. This does not depend here upon the individual shaving behavior, such as is the case, for example, with the known polyox solutions. The razor blade unit according to the invention pertains particular importance in this regard due to the fact that it is particularly suitable for applying natural substances. Natural substances can be more compatible with the skin than the plastics used to date, but they are sensitive to temperature and light. Temperature and light normally lead to breakdown of the natural molecules, and the exposure to air can lead to decomposition by oxygen uptake. All these possible disadvantages of natural substances are excluded due to the storage means according to the shaver head of the present invention. Whereas in the previously described first system of the prior art, between 2 and 5 milligrams of polyox has to be applied per shave in order to achieve an improvement in shaving comfort. The shaver head of the present invention allows an application of approximately 20 milligrams up to approximately 700 milligrams of shaving preparations or the like, thus making it possible to guarantee a sufficient supply of the liquid preparation over the duration of shaving.

The storage means is preferably arranged in the rear region of the shaver head, that is to say in the region of the rear cover cap of the shaver head. The narrow construction of the razor blades is an advantage, leaving enough room in the rear region of the shaver head to provide the storage means therein.

Preferably, the storage means extends essentially over the entire width of the shaver head, so that the entire shaving width is provided with the shaving preparation. The "width" of the shaver head is to be understood in this connection as the extent of the shaver head running transverse to the shaving direction.

In a preferred embodiment, the storage means is a storage chamber. The latter is constructed inside the plastic housing of the shaver head.

In an advantageous development of the storage chamber, the latter is at least partly formed by a transparent material which at least partly forms the lateral surface of the shaver head. This is attended by the advantage that the filling level of the liquid shaving preparation inside the storage chamber is visible from outside, and so can be monitored in a simple way by the user.

The dispenser is advantageously provided with at least one opening constructed in the plastic housing, from which the liquid preparation emerges from the storage chamber during shaving. The opening preferably ends in the region of the cover cap. Alternatively, in the case of double razor blades, the openings end in the region between the razor blades. In the latter case, The openings preferably issue from a common feed from the storage chamber. However, the openings are not restricted to the positions described, they can also end at any other arbitrary position, for example also in front of the razor blades.

For example, a plurality of openings separated from one another can be provided in the form of bores distributed over the width of the shaver head, so the entire shaver width is supplied with the shaving preparation. In this arrangement, the bores preferably have a round cross-section. The opening can also be constructed as a slot extending parallel to the cutting edge of the razor blade. It is possible here, too, to distribute a plurality of slots evenly over the width of the shaver head. It is also conceivable to arrange a plurality of slots above one another.

In a development of the opening or the openings, when the shaver head is held with the razor blades directed vertically downward the openings issue from the floor area of the storage chamber. In this process, it is an advantage that during normal shaving, the shaving motions are directed downward. The liquid shaving preparation with agent and/or scent can then emerge downward through the openings. In this way, feeding of the shaving preparation is guaranteed at any time during the downwardly directed shaver moments.

The openings are preferably formed by a slot-like channel which essentially extends forward parallel to the plane of the razor blade. In this arrangement, the slot-like channel is preferably constructed in the cover cap of the plastic housing. It also possible to provide a plurality of such slot-like channels distributed over the width of the shaver head.

In an alternative embodiment, the opening is provided as a continuous slot, extending parallel to the cutting edge of the razor blade. One longitudinal edge of an elongated strip made of an absorbent material is located within the interior of the storage chamber and is immersed in the liquid preparation. This design is based on the so-called wick principle, in which the absorbent strip becomes saturated with the liquid preparation, so that in the region of the longitudinal edge of the strip located in the slot, the liquid preparation is available at any time and is dispensed by skin contact during shaving. The longitudinal edge thus has the function of a slide strip, which by contrast with known slide strips, draws the feed from the liquid located in the storage chamber. The strip made from the absorbent material can be produced from a natural or artificial substance, it being possible to determine the quantity of liquid to be applied via the capillary size and via the size of the cross-section. This wick principle operates at all angles and positions. In order to prevent artificial evaporation of the shaving preparation and thus, in particular, of the added agents and scents, during storage the application fleece can be covered by an adhesive film.

The longitudinal edge of the strip preferably protrudes somewhat above the top side of the shaver head, and can, furthermore, be rounded off, so that an optimum slide strip is formed.

In a further design configuration, it is possible for there to be arranged on the top side of the shaver head a flap, extending over the width of the head and being swivelable against a spring force, between a basic position which automatically seals the opening by virtue of the spring force and during shaving releases the opening by swiveling by virtue of the exertion of pressure and subsequently once again automatically returns to the sealed position when not in use. During shaving, the flap is actuated and the application openings are opened. Thus, in this embodiment an independent escape of the shaving preparation during the period out of use is excluded.

The flap preferably consists of an elastic material and the swiveling axis is fastened definitively to the top side of the shaver head. Thus, the internal tension of the flap produces the spring force with which the flap is automatically swivelled into the closed position.

In a development of this flap principle, the rear of the cover cap and the front of the flap which is swivelable in this region define mutually corresponding bearing surfaces. The top side of the flap forming in the swivelled open position the rear extension of the cover cap. In this way, a reliable sealing of the openings is guaranteed when the wet shaver is not in use.

In a further embodiment, there is arranged in the storage chamber a tubular cavity, extending over the width of the shaver head and made of a porous, elastic material. The external lateral surface of which is partly located in a perforation constructed on the top side of the shaver head. Furthermore, a body made of an absorbent, compressible material, in particular a sponge, is arranged inside the cavity in order to absorb and thus store the liquid preparation. Push-buttons which can be displaced into the interior of the cavity are arranged in the lateral opposed open ends of the tubular cavity. The actual storage of the shaving preparation is in the sponge-like body, which is arranged inside the cavity. When the user presses upon the push-buttons, the sponge-like body is compressed in such a way that the shaving preparation is pressed into the outer cavity, which is likewise constructed like a sponge and the outer cavity absorbs the shaving preparation. This system allows an individual decision on the quantity of shaving preparation to be applied. In the normal case, the porosity of the cavity is adjusted such that when the push-buttons are actuated once, a sufficient quantity of shaving preparation is applied. However, should the user desire a larger quantity, he can adjust the quantity desired by repeated pumping.

The cavity is preferably arranged exchangeably in the storage chamber, so that the supply of the shaver head with the shaving preparation is continuously guaranteed over the entire service life of the razor blades.

In a further development, the cavity is preferably a hollow cylinder freely rotatable in the storage chamber.

Such an application roller has the advantage of an even dispensation of the shaving preparation, since the hollow cylinder rotates during shaving, its entire lateral surface dispenses the shaving preparation onto the skin.

In a further embodiment, it is proposed that a tubular cartridge displaceable within the storage chamber is arranged therein to receive the liquid preparation. The cartridge having at least one bore which in one setting is located behind the corresponding opening of the plastic housing and in the other setting of the cartridge is closed by the inner wall of the storage chamber. The storage chamber can thus be opened for shaving by an appropriate setting of the cartridge while for nonuse of the shaver the cartridge is adjusted such that its bores are sealed and thus an escape of the shaving preparation contained in the cartridge is prevented. This principle is particularly suitable for thin-bodied and rapidly volatile substances. The cartridge preferably also consists of a transparent material, and in this arrangement forms the lateral surface in the rear region of the shaver head, so that the user can check the filling level inside the cartridge from outside.

In this arrangement, the cartridge is constructed in the form of a hollow cylinder. This has the advantage that it can be arranged rotatably inside the storage chamber, so that two different rotary settings are to be provided for opening and closing the openings.

As an alternative to the rotatable cartridge, the latter can also be arranged inside the storage chamber to be capable of lateral displacement in the direction of the axis. It is preferable in this arrangement to provide laterally attached thrust pads which enable the displacement of the cartridge.

In a similar development, as in the previously described application roller, it is possible for the cartridge preferably to be arranged interchangeably in the storage chamber, so that an empty cartridge can be replaced by a full one, guaranteeing the supply of the shaving preparation over the entire service life of the razor blade.

As an alternative to the storage chamber, in a further embodiment, the storage means for the liquid preparation is formed by an elastic, porous roller, which is also impregnated with the liquid preparation and is mounted, parallel to the cutting edge of the razor blade, to be freely rotatable in the plastic housing and projecting above the top side of the latter. This sponge roller for the storage element is the carrier for the liquid preparation, it being the case that during shaving the roller rolls on the user's skin and in so doing gradually dispenses the liquid preparation.

It is proposed as an alternative that the storage element for the liquid preparation consists of a strip, which is parallel to the cutting edge of the razor blade. The strip is made of a porous, elastic material which is also impregnated with the liquid preparation, and which is arranged on the top side of a swivelable flap of the plastic housing. In this arrangement, in common with the sponge-like strip, the flap swivels during shaving into the operating position, in which the top side of the strip forms the rear extension of the cover cap.

Finally, in a development of the shaver head it is proposed that when not being used the shaver head is provided with cover means for covering the storage means. A cover film is provided for preventing the gradual evaporation of the shaving preparation during prolonged storage of the shaver.

It is to be understood that both this general description and the following detailed description are exemplary and explanatory only and are not restrictive of the invention as claimed.

BRIEF DESCRIPTION OF THE DRAWINGS

The accompanying drawings which are incorporated in and constitute a part of the specification illustrate the embodiments of the invention, and together with the description, serve to explain the objects, advantages and principles of the invention.

FIG. 3 is a perspective view of a second embodiment of the razor blade unit of the present invention;

FIG. 4 is a cross-sectional view of the shaver head of FIG. 3;

FIG. 13 is a perspective view of a seventh embodiment of the shaver head of the present invention;

FIG. 14*a* is a cross-sectional view of the shaver head of FIG. 13;

FIG. 14*b* is a cross-sectional view of the shaver head of FIG. 13, with the flap swivelled during use;

DESCRIPTION OF THE PREFERRED EMBODIMENTS

Figure 1:
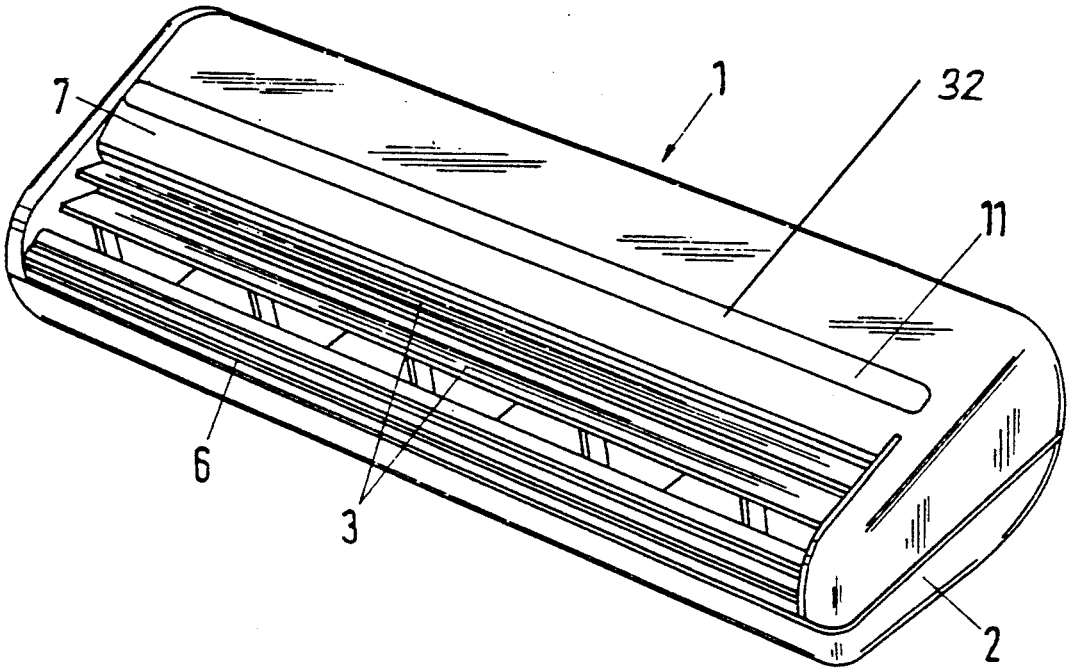
FIG. 1 is a perspective view of a first embodiment of the shaver head of the present invention.
Figure 2:
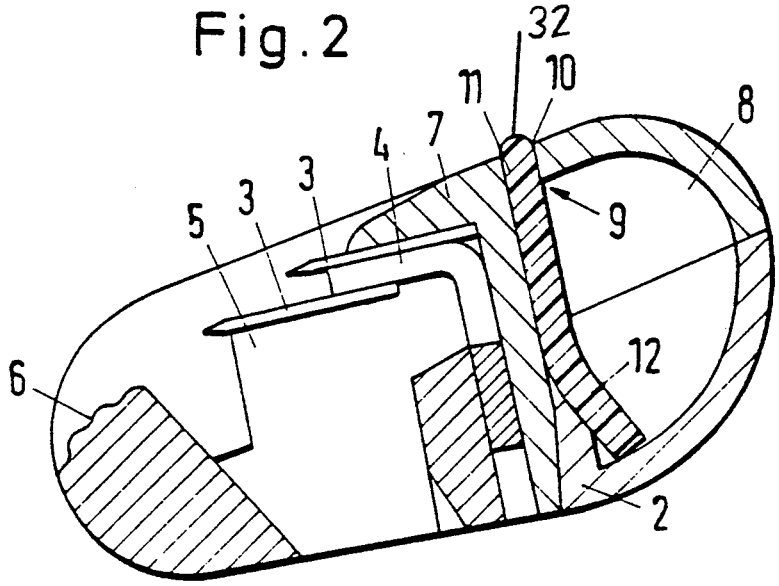
FIG. 2 is a cross-sectional view of the shaver head of FIG. 1.
Figure 5:
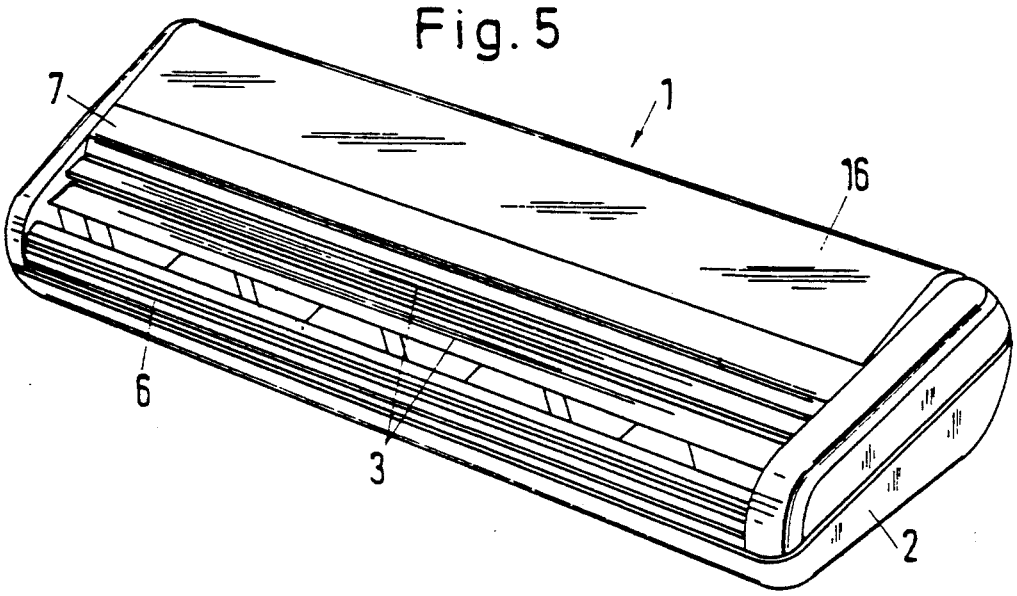
FIG. 5 is a perspective view of a third embodiment of the razor blade unit of the present invention.

A total of eight embodiments of a shaver head according to the invention are represented in the drawings in the form of razor blade units 1. Razor blade units 1 are fastened by means of an interlock mechanism to the front end of a handle (not shown). A razor blade 3 in the form of a double razor blade is permanently embedded in a plastic housing 2. As may be seen in the sectional representations of each case embodiment, an L-shaped spacer 4 is provided for supporting the blade, one leg of which the two razor blades 3 are fastened on both sides, while the other leg of the spacer 4 is fixed in the plastic housing 2. In this arrangement, the razor blades 3 respectively rest on a blade platform 5 of the plastic housing 2.

Furthermore, all of the embodiments of the razor blade unit 1 have a front guide strip 6, which extends parallel to the cutting edges of the razor blades 3, and a rear cover cap 7, which essentially rests on the top razor blade 3 and defines the cutting geometry in conjunction with the front guide strip 6 and the razor blades 3.

The razor blade units 1 have in the rear region storage means for a liquid shaving preparation (which can also be perfumed), skin care preparations, or the like. Since the razor blades 3 are constructed narrowly, there is enough room behind them in the razor blade unit 1 to arrange the storage means, without the razor blade unit 1 having to be disadvantageously enlarged.

In the first five embodiments (FIG. 1 to FIG. 10) and in the eighth embodiment (FIG. 15 to FIG. 19) the storage means is respectively constructed as a storage chamber 8. In the sixth and seventh embodiments (FIG. 11 to FIG. 14*b*) the storage means is formed by a sponge-like element, in which the liquid shaving preparation is absorbed.

In the case of the first embodiment (FIGS. 1 and 2), a storage chamber 8 for receiving the liquid shaving preparation is defined in the rear region of the razor blade unit 1. This storage chamber 8 is formed by a bottom part of the plastic housing 2, which is constructed in the rear region in the form of a pan. A top part, likewise in the form of a pan (with the opening facing downward) which also defines the cover cap 7 at the same time, is fitted onto this bottom part of the plastic housing 2. The top and bottom parts of the plastic housing 2 are permanently connected to one another in such a way that the liquid shaving preparation cannot escape at the point of contact between these two parts.

Plastic housing 2 has an opening 9 in the region of the cover cap 7 in the form of a continuous slot 10 extending parallel to the cutting edges of the razor blades 3. Located in this slot 10 is one longitudinal edge 11 of a strip 12, made of an absorbent material, the lower end of which projects into the storage chamber 8 and is immersed in the liquid shaving preparation. The absorbent material can be produced from a natural or artificial material, this embodiment operating in accordance with the socalled wick principle. In this process, the quantity of liquid shaving preparation to be applied can be determined via the capillary size and via the size of the cross-section of the strip 12. Since the strip 12 is permanently immersed in the liquid shaving preparation, this system operates at all angles and positions. In order to prevent the artificial evaporation of the liquid shaving preparation and thus, in particular, of the added agents and scents during storage, the application fleece in the form of the strip 12 can be covered by an adhesive film 32.

In the second embodiment (FIGS. 3 and 4), a storage chamber 8 is likewise defined in the rear region of the razor blade unit 1. In terms of design, chamber 8 is formed in a corresponding fashion to the storage chamber of the first embodiment. Here, too, in the upper region of the plastic housing 2 and thus in the region of the cover cap 7, the storage chamber 8 has openings 9 in the form of slots 13. Slots 13, subdivided by webs, extend parallel to the cutting edges of the razor blades 3 over the width of the razor blade unit 1. Slots 13 are part of channels 14 which, starting from the storage chamber 8, extend forward parallel to the planes of the razor blades 3.

In this embodiment, the application of the liquid shaving preparation takes place through the small slots 13 in the cover cap 7. The principle of operation is such that shaving is normally started with downwardly directed shaving movements. Since the channels 14 are arranged in the region of the floor of the storage chamber 8 in the downward shaving position of the razor blade unit 1, the liquid shaving preparation located in the storage chamber 8 emerges from the downwardly directed slots 13 by virtue of gravity. In this arrangement, the slot size must be coordinated with the viscosity of the liquid shaving preparation. The application quantity is determined by the slot size and by the shaving time.

This embodiment is particularly suitable for shaving preparations that require a large quantity of application. Here, too, the independent escape of the liquid shaving preparation can be prevented during storage by fastening the razor blade unit 1 on blister cards with the storage chamber 8 facing downward, and by sealing the slots 13 by a strip, for example in the form of an adhesive film. In order to prevent independent escape of the shaving preparation during storage between shaves, the shaver is hung or laid in a holder in such a way that the slots 13 point upward.

Figure 6A:
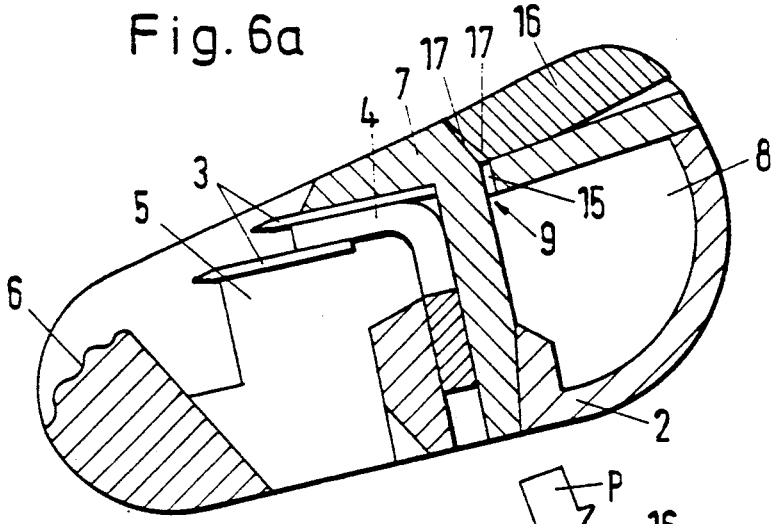
FIG. 6*a* is a cross-sectional view of the shaver head of FIG. 5.
Figure 6B:
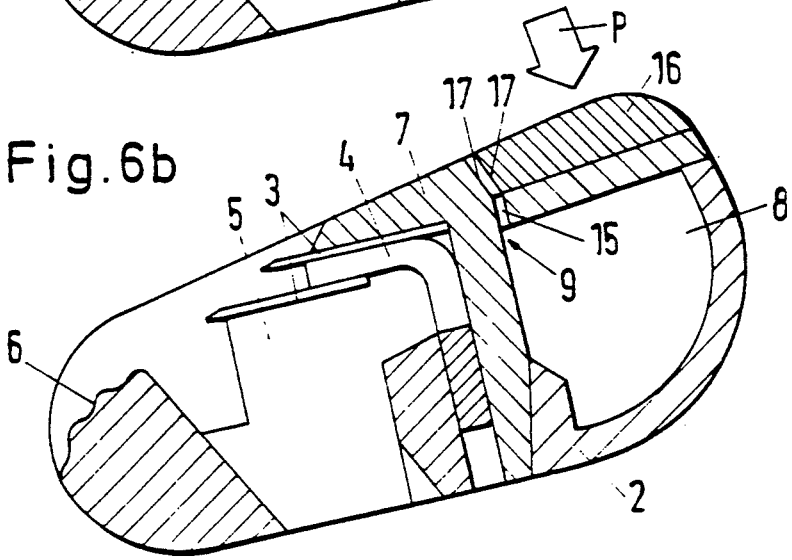
FIG. 6*b* is a cross-sectional view of the shaver head of FIG. 5, with the flap swivelled during use.
Figure 7:
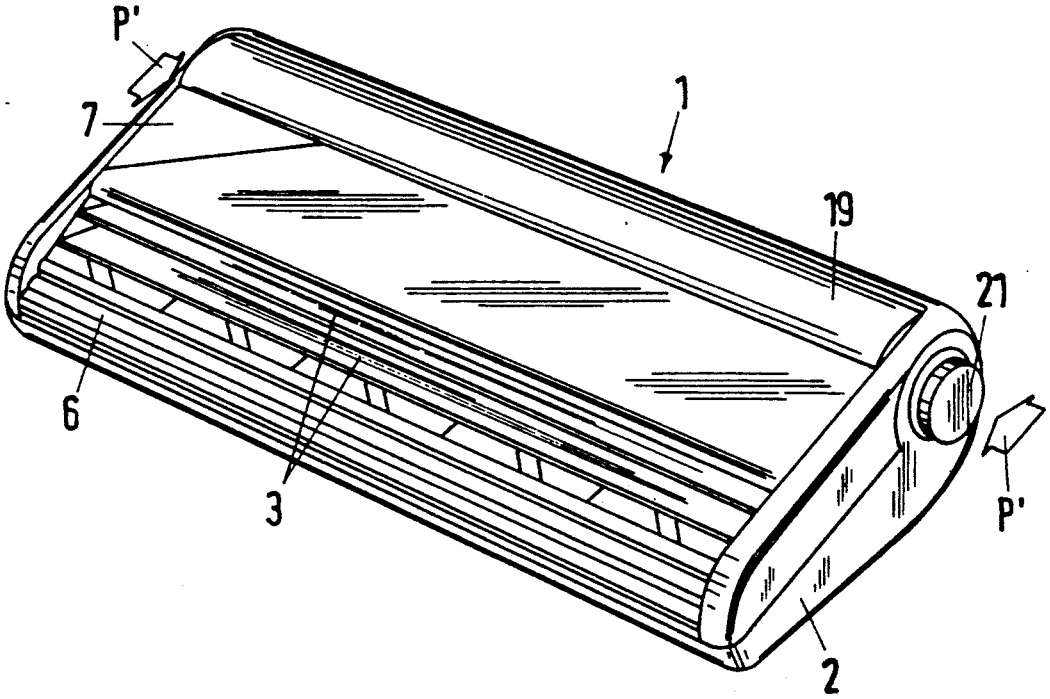
FIG. 7 is a perspective view of a fourth embodiment of the shaver head of the present invention.
Figure 8:
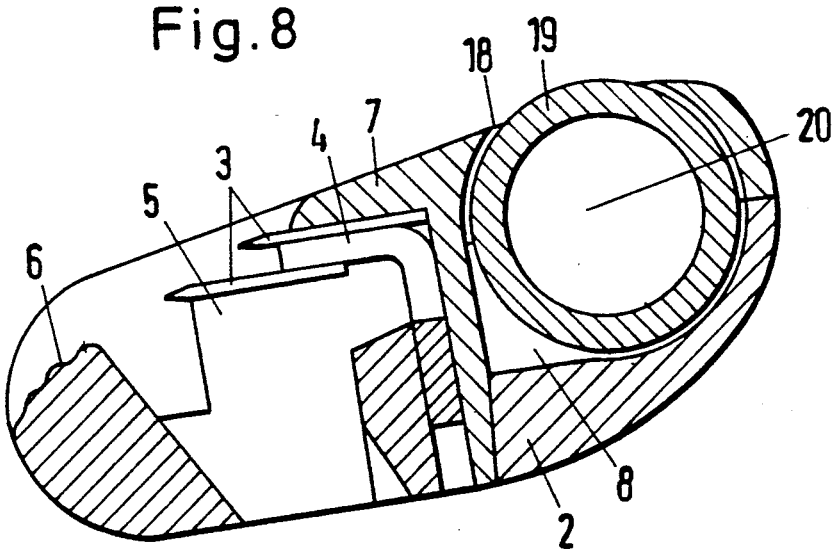
FIG. 8 is a cross-sectional view of the shaver head of FIG. 7.
Figure 9:
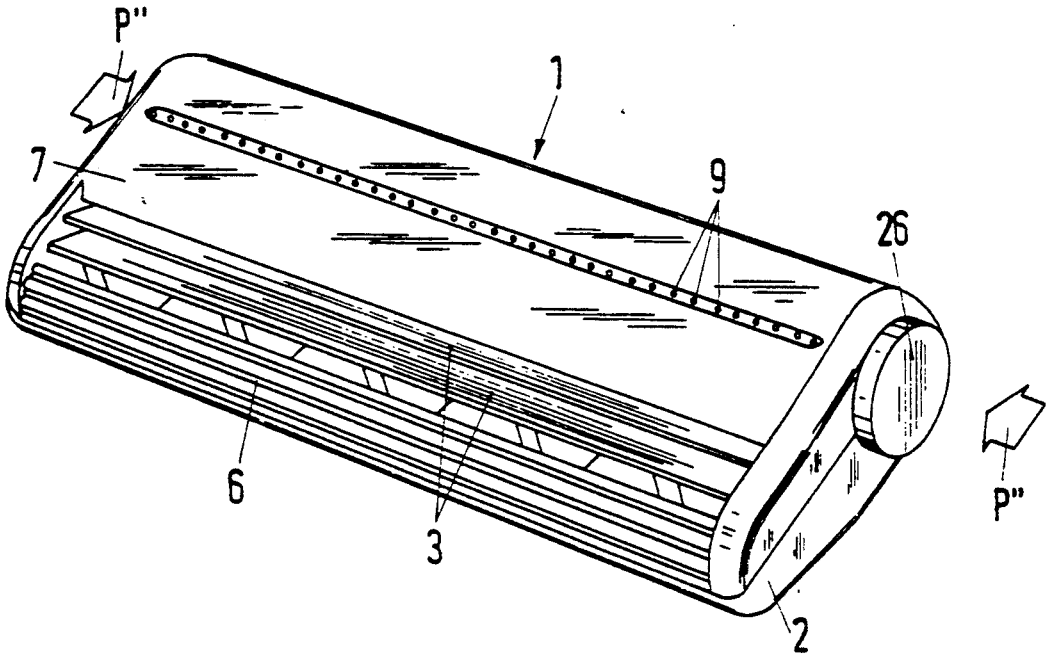
FIG. 9 is a perspective view of a fifth embodiment of the shaver head of the present invention.
Figure 10:
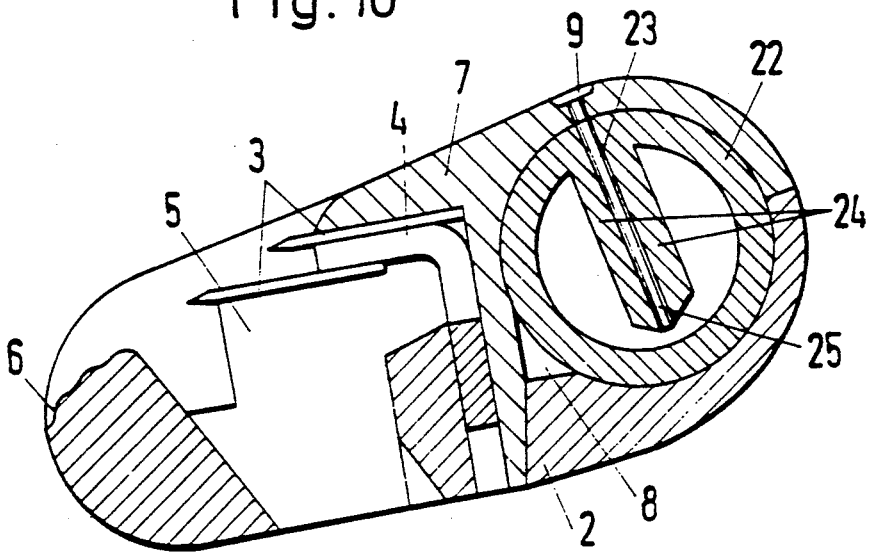
FIG. 10 is a cross-sectional view of the shaver head of FIG. 9.
Figure 11:
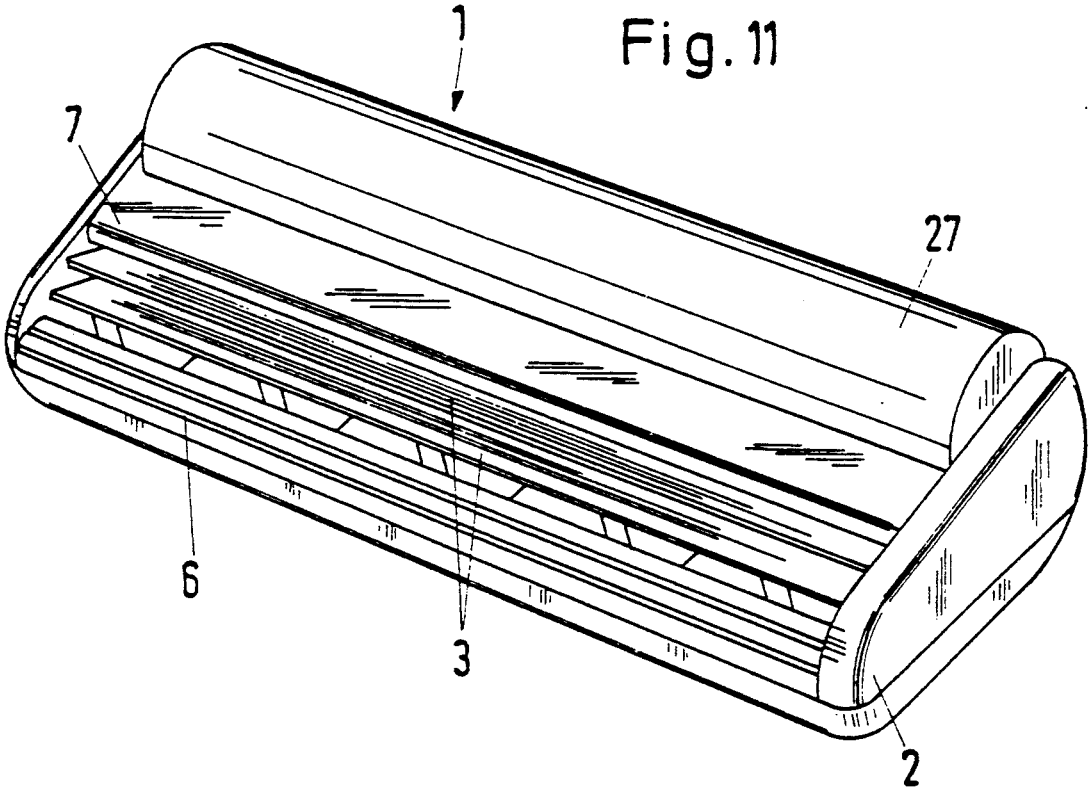
FIG. 11 is a perspective view of a sixth embodiment of the shaver head of the present invention.
Figure 12:
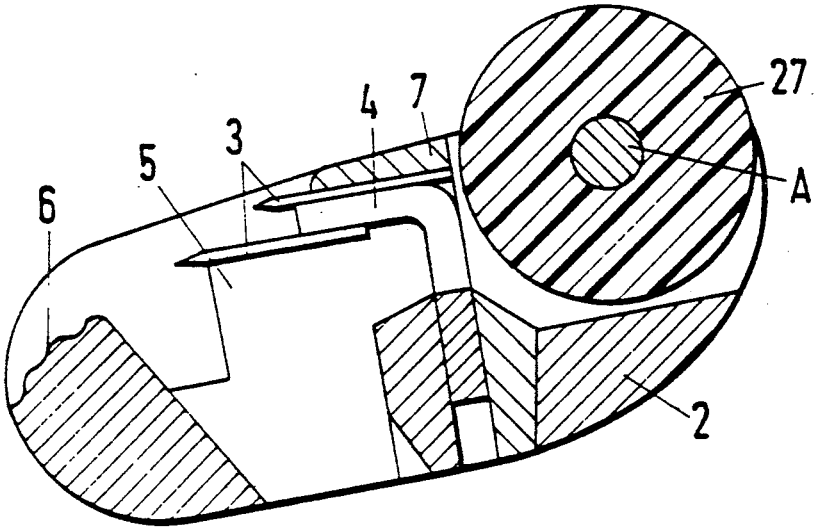
FIG. 12 is a cross-sectional view of the shaver head of FIG. 11.
Figure 15:
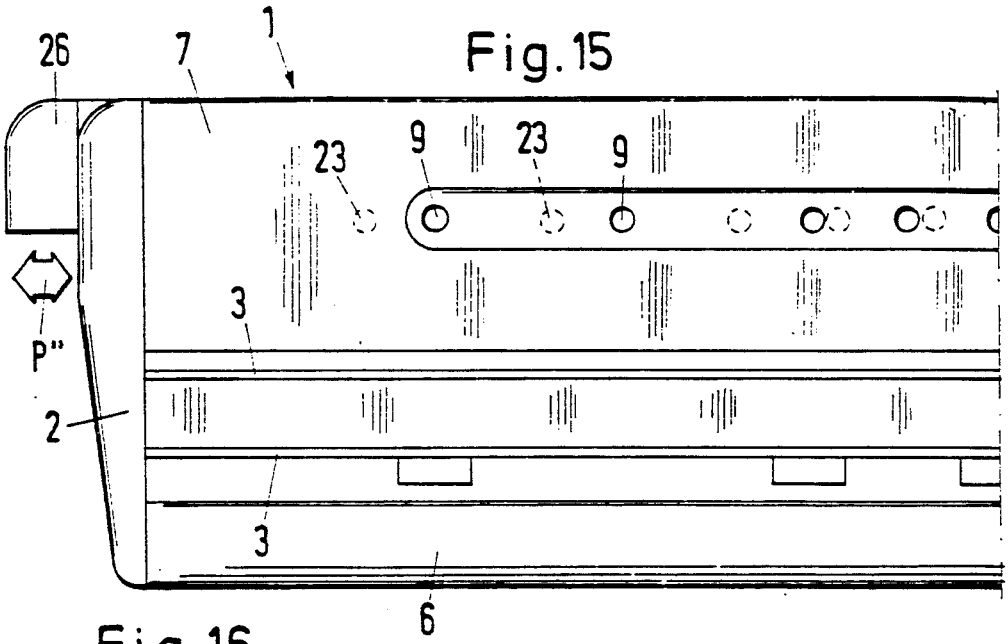
FIG. 15 is a half-view from of the top of an eighth embodiment of the shaver head of the present invention.
Figure 16:
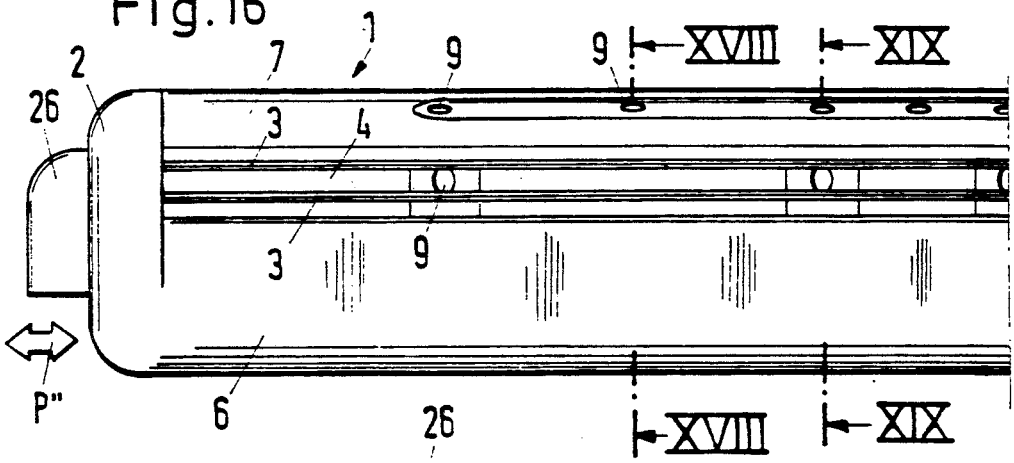
FIG. 16 is a front view of the shaver head of FIG. 15.
Figure 17:
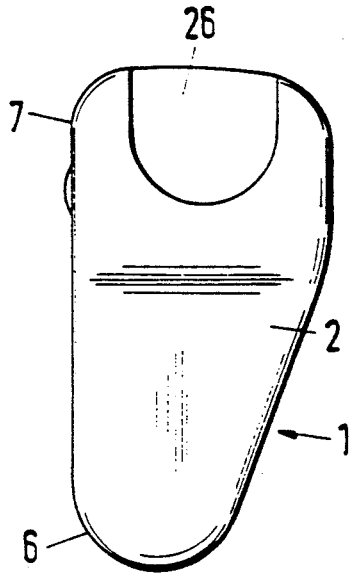
FIG. 17 is a right side view of the shaver head of FIG. 15.
Figure 18:
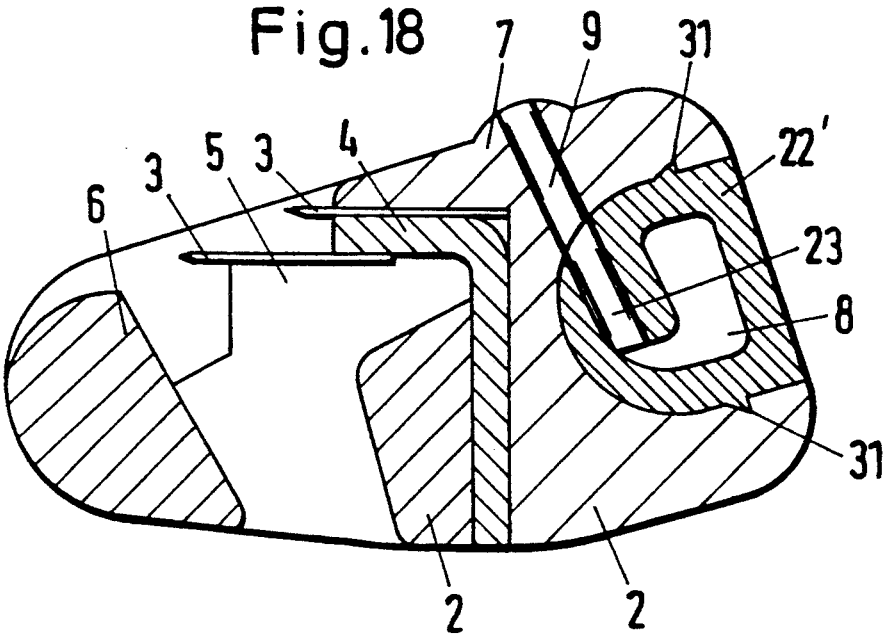
FIG. 18 is a cross-sectional view of the shaver head along the line XVIII—XVIII of FIG. 16.
Figure 19:
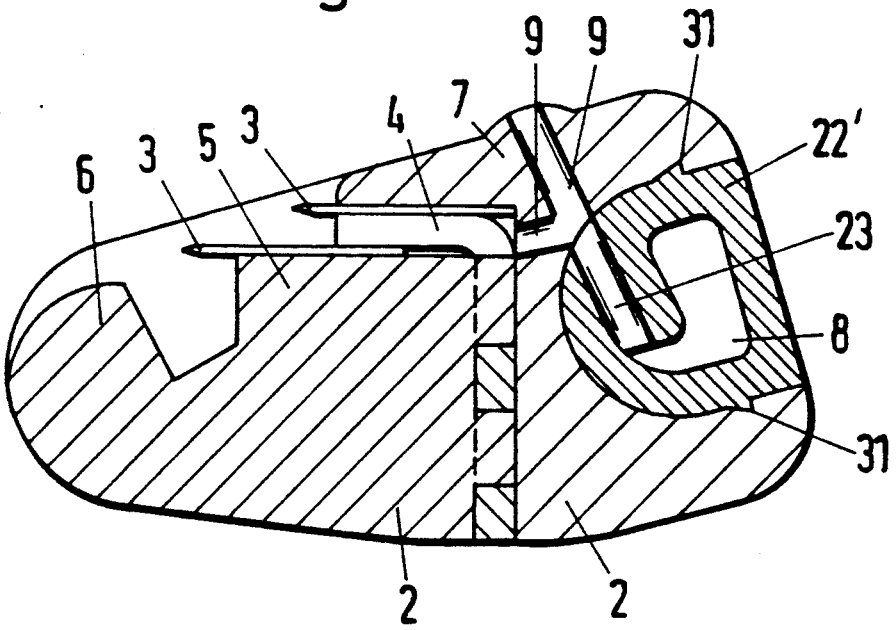
FIG. 19 is a cross-sectional view along the line XIX—XIX of FIG. 16.

In the third embodiment (FIGS. 5 to 6*b*), a storage chamber 8 is likewise defined in the rear region of the razor blade unit 1 by the plastic housing 2. Plastic housing 2 has a continuous slot 15, which forms the opening 9 of the storage chamber 8 in the region of the cover cap 7. In order to prevent escape of the liquid shaving preparation, located in the storage chamber 8, during nonuse of the shaver, slot 15 is sealed by a flap 16 (FIG. 6*a*). In this arrangement, the rear of the cover cap 7 forms respectively mutually corresponding bearing surfaces 17 with the front of the flap 16. In this arrangement, the flap 16 consists of an elastic material, and is fastened in the region of the slot 15 to the plastic housing 2 in such a way that during shaving the flap 16 is swivelled by virtue of the exertion of pressure, so that the bearing surfaces 17 lift away from one another and open the slot 15. This is indicated in FIG. 6*b* by the arrow P. The top side of the flap 16 thereby forms the rear extension of the cover cap 7. After use, the flap 16 returns once again to its closed position.

In the fourth embodiment (FIGS. 7 and 8), a storage chamber 8 is constructed in the plastic housing 2 in the rear region of the razor blade unit 1, but this storage chamber differs from the preceding embodiments with reference, in particular, to the storage and manner of dispensing the liquid shaving preparation. The upper rear region of the plastic housing 2 has a relatively wide slot-like perforation 18 which extends parallel to the cutting edges of the razor blades 3 behind the cover cap 7. A tubular cavity 19 in the form of a hollow cylinder is arranged freely rotatably inside the storage chamber 8. The cylinder consists of a porous, elastic material and has the function of an application roller. A porous body 20 in the form of a sponge, which is impregnated with the liquid shaving preparation, is located inside the cavity 19. Furthermore, the system has push-buttons 21, which are mounted in the side walls of the plastic housing 2 and protect laterally into the two open ends of the cavity 19. In this process, these push-buttons 21 can be pressed (as indicated by the arrows P') into the interior of the cavity 19 in such a way that the sponge-like body 20 located therein is compressed causing the liquid shaving preparation to penetrate into the porous cavity 19. Cavity 19 impregnated with the liquid shaving preparation, dispenses the liquid shaving preparation during shaving due to the exertion of pressure by the user.

The application roller allows an individual to decide on the quantity of the liquid shaving preparation applied. Normally, the porosity of the cavity 19 is adjusted such that a sufficient quantity of shaving preparation is applied with a single pumping by means of the push buttons 21. However, should the user desire a larger quantity, he can adjust the quantity required by repeated pumping.

The fifth embodiment (FIGS. 9 and 10) likewise provides the use of a storage chamber 8 in the rear region of the plastic housing 2 of the razor blade unit 1. In this arrangement, the top side of the plastic housing 2 has a row of openings 9 in the form of bores parallel to the cutting edges of the razor blades 3, as seen in the perspective view in accordance with FIG. 9. It is essential in this embodiment that a tubular cartridge 22, which is respectively sealed at ends forming a self-contained vessel, is arranged inside the storage chamber 8 to receive the liquid shaving preparation. In this arrangement, the cartridge has bores 23, which are distributed over the length of the lateral surface and in particular, with respect to the intermediate spaces, correspond to the openings 9 of the storage chamber 8. In the interior, the cartridge 22 has channels 25, which are formed by extensions 24 and which end in the bores 23 on the lateral surface of the cartridge 22. The cartridge 22 is arranged in a laterally displaceable fashion inside the plastic housing 2. The displacement of the cartridge 22 can be accomplished by lateral actuating buttons 26, the direction of actuation being indicated by the arrows rows P''. By virtue of the lateral displacement of the cartridge 22, the bore-like openings 9 of the plastic housing 2 can be open and closed, owing to the fact that in the open position the bores 23 in the cartridge 22 are located exactly behind the openings 9 of the plastic housing 2. In the closed position after displacement of the cartridge 22, the bores 23 are located behind the partition walls between the openings 9 of the plastic housing 2, so that the partition wall seals the bores 23 of the cartridge 22.

This principle is suitable, in particular, for thin-bodied and rapidly volatile substances. The quantity applied during shaving is determined by the spacing and the size of the openings 9 and the bores 23. In this arrangement, the application quantity can be matched to the load profile, which is produced by the different load zones of the razor blade unit 1. In this regard the load, and thus also the requirement for shaving preparations, is greatest in the middle region of the razor blade 3, while the load requirement is reduced toward the edges.

The sixth embodiment (FIGS. 11 and 12) does not utilizes storage chamber 8 for the liquid shaving preparation in the sense of the embodiments previously described. Instead, in the sixth embodiment a roller 27 made of an elastic, porous material is mounted, freely rotatable about an axis A parallel to the cutting edges of the razor blades 3. The roller 27 is disposed in the rear region of the razor blade unit 1 in the side walls of the plastic housing 2. This sponge-like roller 27 is impregnated with the liquid shaving preparation, so that by virtue of its elasticity the shaving preparation is pressed out onto the skin by the person during shaving. Roller 27 projects over the cover cap 7 as shown in the sectional representation in accordance with FIG. 12.

The seventh embodiment (FIGS. 13 to 14*b*) also does not utilize a storage chamber 8 for receiving the liquid shaving preparation in the sense of the first five embodiments. Rather, a flap 29 is swivelably hinged at the rear longitudinal edge of the cover cap 7 via a film hinge 28. The top side of flap 29 carries a strip 30 having an essentially triangular cross-section and made of an elastic, porous material. In the basic position, as shown in FIG. 14*a*, the strip 30 projects over the rear extension of the cover cap 7 when the shaver is not in use. The sponge-like strip 30 is impregnated with the liquid shaving preparation. During shaving, the top side of the razor blade unit 1 is pressed against the skin by the user. Consequently, the flap 29 is swivelled downward with its strip 30 in accordance with the arrow P''' (FIG. 14*b*) in such a way that one leg of the strip 30 forms the rear extension of the cover cap 7. By virtue of the elastic construction of the strip 30, the liquid shaving preparation contained therein is pressed out and thus dispensed onto the skin. In this arrangement, the flap 27 is hinged to the cover cap 7 with such an internal stress that it tends to return to the basic position represented in FIG. 14*a*, ready to press against the skin of the user during shaving.

Finally, the eight embodiment (FIGS. 15 to 19) likewise provides, as in the case of the first five embodiments, for the use of a storage chamber 8 in the rear region of the plastic housing 2 of the razor blade unit 1. In this arrangement, the top side of the plastic housing 2 has in the region of the cover cap 7, a row of openings 9 in the forms of bores, which respectively have a round cross-section and are parallel to the cutting edges of the razor blades 3. Openings 9 are arranged more closely in the middle region of the razor blade unit 1 than toward the outside edges. Aside from these openings 9 in the region of the cover cap 7, this embodiment has additional openings 9 which end in the rear region between the two razor blades 3, as shown in the cross-sectional representation of FIG. 19. Openings 9 respectively issue from a common feed from the storage chamber 8. However, not every opening 9 that ends in the region of the cover cap 7 is allocated an opening 9 that ends between the two razor blades 3. As may be seen, in particular, in FIG. 16, an opening 9 ending in the cover cap 7 is alternatively omitted.

In a manner conforming to that of the fifth embodiment (FIGS. 9 and 10), a tubular cartridge 22' made of a transparent material is arranged inside the storage chamber 8 to receive the liquid shaving preparation. This cartridge 22' is respectively sealed at both ends, and thus forms a self-contained vessel. As may be seen from the sectional representations in accordance with FIGS. 18 and 19, the cartridge 22' is inserted at the rear into the plastic housing 2 of the razor blade unit 1, and held therein by barbs 31. The cartridge 22' is thus visible from outside, so that by virtue of the transparency of the material the filling level in the interior of the cartridge 22' can be monitored.

Furthermore, the cartridge 22' has bores 23 distributed over the length of the lateral surface, which correspond in particular with respect to the intermediate spaces, to the feeds of the openings 9 of the storage chamber 8. It is likewise essential in this embodiment that the cartridge 22' is arranged laterally displaceably inside the plastic housing 2. The displacement of the cartridge 22' can be achieved by lateral actuating buttons 26, tho direction of actuation being indicated by the arrows P''. By virtue of the lateral displacement of the cartridge 22', the borelike feeds to the openings 9 of the plastic housing 2 can be opened and closed. In the open position the bores 23 of the cartridge 22' are located exactly behind the feeds with the openings 9 of plastic housing 2. In the closed position after displacement of the cartridge 22' the bores 23 of the cartridge are located behind the partition walls between the feeds to the openings 9 of the plastic housing 2, so that the partition walls seal the bores 23 of the cartridge 22'.

Just as in the fifth embodiment (FIGS. 9 and 10), this principle is particularly suitable for thin-bodied and rapidly volatile substances. The spacing and the size of the openings 9 and of the bores 23 determine in this arrangement the quantity of liquid preparation applied during shaving. The application quantity can be matched to the load profile, which is produced by the different load zones of the razor blade unit 1. In this regard, the load, and thus also the requirement for shaving preparations is largest in the middle region of the razor blade 3, while reduced towards the edges.

For this reason, in the case of this eighth embodiment of the razor blade unit 1 the openings 9 are denser in the middle region than in the edge region.

Other embodiments of the invention will be apparent to those skilled in the art from consideration of the specification and practice of the invention disclosed herein. It is intended that the specification be considered exemplary only, with a true scope and spirit of the invention being indicated by the following claims.

What is claimed is:

1. A shaver head for a wet shaver, comprising:

a plastic housing including a front guide strip and a rear cover cap; and storage means disposed in the plastic housing for receiving a liquid preparation, the storage means including dispensing means disposed relative to the front guide strip and the rear cover cap for applying the liquid preparation in response to contact between the surface to be saved and the dispensing means during shaving.

2. The shaver head of claim 1, further comprising at least one razor blade having a cutting edge supported by said plastic housing.

3. The shaver head of claim 2, wherein the dispensing means includes at least one opening disposed in said plastic housing through which said liquid preparation is dispensed during shaving.

4. The shaver head of claim 3, wherein said storage means comprises a storage chamber.

5. The shaver head of claim 4, wherein said storage chamber is at least partially formed of a transparent material which forms a surface extending laterally and parallel to the cutting edge of the blade of the shaver head.

6. The shaver head of claim 4, wherein said at least one opening comprises a slot extending parallel to the cutting edge of the at least one razor blade.

7. The shaver head of claim 6, wherein the dispensing means includes an elongated strip of absorbent material located in said slot, said strip including opposite longitudinal edges, one of said edges being disposed in the interior of said storage chamber for immersion in said liquid preparation.

8. The shaver head of claim 7, wherein the other longitudinal edge of said strip extends through said slot exterior of said plastic housing for contact with the surface to be shaved during shaving.

9. The shaver head of claim 4, wherein a tubular cartridge containing said liquid preparation is disposed in said storage chamber, said tubular cartridge being laterally displaceable within said storage chamber and including at least one bore for dispensing said liquid preparation.

10. The shaver head of claim 9, wherein said tubular cartridge is laterally displaceable between a first position wherein said at least one bore is in alignment with said at least one opening in said plastic housing and a second position wherein said at least one bore is closed by an inner wall of the storage chamber.

11. The shaver head of claim 9, wherein said tubular cartridge is a hollow cylinder.

12. The shaver head of claim 9, wherein said tubular cartridge is rotatably disposed in said storage chamber.

13. The shaver head of claim 9, wherein said tubular cartridge is removably mounted in said storage chamber.

14. The shaver head of claim 3, wherein said at least one opening is located in the vicinity of said cover cap.

15. The shaver head of claim 3, wherein said at least one opening comprises a slot-like channel extending essentially parallel to a plane of said at least one razor blade.

16. The shaver head of claim 3, wherein the dispensing means includes a flap extending over the width of said shaver head and being swivelable against a spring force between a first position wherein the flap seals the at lest one opening a second position wherein the flap uncovers the at least one opening in response to the pressure exerted by a user during shaving.

17. The shaver head of claim 16, wherein said flap comprises an elastic material and includes a swivelling axis portion, and swivelling axis portion fastening a rear portion of said cover cap to said shaver head.

18. The shaver head of claim 17, wherein the flap includes a front side, the rear portion of said cover cap and the front side of said flap defining mutually corresponding bearing surfaces.

19. The shaver head of claim 16, wherein when said flap is in said second position a top side of said flap forms a rear extension of said cover cap.

20. The shaver head of claim 3, wherein the rear cover cap includes a perforation extending parallel to the cutting edges of the razor blades and the storage chamber comprises a tubular cavity extending along the width of the shaver head disposed in said perforation, the cavity being made of a porous elastic material and having an external surface extending above the perforation for contact with the surface to be shaved.

21. The shaver head of claim 20, wherein a body is disposed in said cavity, said body comprising an absorbent, compressible material capable of absorbing and storing the liquid preparation.

22. The shaver head of claim 21, wherein said body is a sponge.

23. The shaver head of claim 21 wherein at least one pushbutton is disposed in each of the opposed open ends, said pushbuttons being displaceable into the interior of the cavity to compress said body.

24. The shaver head of claim 20, wherein said cavity is a hollow cylinder freely rotatable within the storage chamber.

25. The shaver head of claim 24, wherein said hollow cylinder is removably mounted in said storage chamber.

26. The shaver head of claim 2, wherein said storage means comprises an elastic, porous roller impregnated with said liquid preparation, said roller being rotatably mounted within said housing and parallel to the cutting edge of the at least one razor blade, said roller projecting above a top side of the housing.

27. The shaver head of claim 1, wherein the plastic housing includes a rear region, said storage means being arranged in said rear region.

28. The shaver head of claim 3, wherein said storage means extends over the entire width of the shaver head.

29. The shaver head of claim 27, wherein the plastic housing includes a swivelable flap having a top side hinged to the cover cap, said flap extending over the width of said shaver head.

30. The shaver head of claim 29, further comprising at least one razor blade having a cutting edge supported by said plastic housing; and wherein said storage means comprises a strip of a porous elastic material mounted on the top side of said flap, said strip being impregnated with the liquid preparation and extending parallel to the cutting edge of the at least one razor blade.

31. The shaver head of claim 1, further comprising means for covering said storage means to prevent evaporation of said liquid preparation.

32. The shaver head of claim 31, wherein said cover means comprises a cover film.

33. The shaver head of claim 1, further comprising at least two razor blades supported by said plastic housing, each of said blades including a cutting edge.

34. The shaver head of claim 33, wherein a plurality of separated openings are distributed over the width of the shaver head.

35. The shaver head of claim 34, wherein said plurality of openings each comprise a bore, said bore opening into a region of the cover cap and in a region between the at least two razor blades.

36. The shaver head of claim 34, wherein each of said plurality of openings issue from the bottom of said storage chamber when said at least two razor blades are pointed downward.

37. A shaver head for a wet shaver, comprising:

a plastic housing including a front guide strip and a rear cover cap;

storage means including a storage chamber disposed in the plastic housing for receiving a liquid preparation;

at least one razor blade having a cutting edge supported by said plastic housing;

the storage means including dispensing means having at least one slot in said plastic housing extending parallel to the cutting edge of the at least one razor blade for dispensing the liquid preparation during shaving; and the dispensing means includes an elongated strip of absorbent material located in said slot, said strip including opposite longitudinal edges, one of said edges being disposed in the interior of said storage chamber for immersion in said liquid preparation.

38. The shaver head of claim 37, wherein the other longitudinal edge of said strip extends through said slot exterior of said plastic housing for contact with the surface to be shaved during shaving.

39. A shaver head for a wet shaver, comprising:

a plastic housing including a front guide strip and a rear cover cap;

storage means including a storage chamber disposed in the plastic housing for receiving a liquid preparation wherein the storage chamber includes a tubular cartridge containing said liquid preparation disposed in said storage chamber, said tubular cartridge being laterally displaceable within said storage chamber and including at least one bore for dispensing said liquid preparation through an opening in said plastic housing during shaving; and at least one razor blade having a cutting edge supported by said plastic housing.

40. The shaver head of claim 39, wherein said tubular cartridge is laterally displaceable between a first position wherein said at least one bore is in alignment with said at least one opening in said plastic housing and a second position wherein said at least one bore is closed by an inner wall of the storage chamber.

41. The shaver head of claim 39, wherein said tubular cartridge is a hollow cylinder.

42. The shaver head of claim 39, wherein said tubular cartridge is rotatably disposed in said storage chamber.

43. The shaver head of claim 39, wherein said tubular cartridge is removably mounted in said storage chamber.

44. A shaver head for a wet shaver, comprising:

a plastic housing including a front guide strip and a rear cover cap;

at least one razor blade having a cutting edge supported by said plastic housing; and a storage means disposed in the plastic housing for receiving a liquid preparation wherein said storage means comprises an elastic, porous roller impregnated with said liquid preparation, said roller being rotatably mounted within said housing and parallel to the cutting edge of the at least one razor blade, said roller projecting above a top side of the housing.

45. A shaver head for a wet shaver, comprising:

a plastic housing including a front guide strip and a rear cover cap;

storage means disposed in the plastic housing for receiving a liquid preparation, the storage means including dispensing means for dispensing the liquid preparation during shaving;

wherein the plastic housing includes a rear region, said storage means being arranged in said rear region; and wherein the plastic housing includes a swivelable flap having a top side hinged to the cover cap, said flap extending over the width of said shaver head.

46. The shaver head of claim 45, further comprising at least one razor blade having a cutting edge supported by said plastic housing; and wherein said storage means comprises a strip of porous elastic material mounted on the top side of said flap, said strip being impregnated with the liquid preparation and extending parallel to the cutting edge of the at least one razor blade.

* * * * *